US012539999B1

(12) United States Patent
Mitri et al.

(10) Patent No.: US 12,539,999 B1
(45) Date of Patent: Feb. 3, 2026

(54) PORTABLE CASE WITH SPINDLES FOR ACCESSORIES AND RELATED METHODS

(71) Applicant: Cord LLC, Las Vegas, NV (US)

(72) Inventors: Salim Mitri, Rocklin, CA (US); Joel Switzer, Somerset, CA (US)

(73) Assignee: CORD LLC, Las Vegas, NV (US)

( * ) Notice: Subject to any disclaimer, the term of this patent is extended or adjusted under 35 U.S.C. 154(b) by 0 days.

(21) Appl. No.: 19/314,092

(22) Filed: Aug. 29, 2025

(51) Int. Cl.

| | |
|---|---|
| ***B65D 25/06*** | (2006.01) |
| ***B65D 1/24*** | (2006.01) |
| ***B65D 1/40*** | (2006.01) |
| ***B65D 25/08*** | (2006.01) |
| ***B65D 85/04*** | (2006.01) |
| *B65D 25/28* | (2006.01) |

(52) U.S. Cl.
CPC ..... *B65D 1/24* (2013.01); *B65D 1/40* (2013.01); *B65D 25/06* (2013.01); *B65D 25/08* (2013.01); *B65D 85/04* (2013.01); *B65D 25/2808* (2013.01)

(58) Field of Classification Search
CPC . B65D 25/06; B65D 1/24; B65D 1/40; B65D 85/04
USPC ..... 220/534
See application file for complete search history.

(56) References Cited

U.S. PATENT DOCUMENTS

| | | | | |
|---|---|---|---|---|
| 1,047,959 | A | 12/1912 | Maclaren | |
| 4,838,445 | A * | 6/1989 | Lanius | B65D 25/06 220/533 |
| 5,152,395 | A * | 10/1992 | Cross | B65D 85/04 211/26 |
| 5,178,257 | A * | 1/1993 | Cross | B65D 85/04 198/465.1 |
| 6,651,814 | B2 | 11/2003 | Higbee et al. | |
| 8,251,212 | B2 | 8/2012 | Dunlap | |
| 8,387,909 | B2 | 3/2013 | Galgano et al. | |
| 8,929,708 | B2 | 1/2015 | Pimentel et al. | |
| 11,319,142 | B2 | 5/2022 | Crossett et al. | |
| 2006/0249515 | A1* | 11/2006 | Dobrinski | B65D 25/10 220/544 |
| 2012/0255884 | A1* | 10/2012 | McKillip | B65D 75/54 206/703 |
| 2015/0373963 | A1* | 12/2015 | Harrell | A01K 97/05 43/54.1 |
| 2021/0339910 | A1* | 11/2021 | Schuldt | A47F 5/005 |

OTHER PUBLICATIONS

GUS "Cord Corral Cable Organizer" 6 Cord Spindles For Under Desk Organization—Great Useful Stuff: retrieved from internet Jul. 3, 2025; pp. 23.

* cited by examiner

*Primary Examiner* — Stephen J Castellano
(74) *Attorney, Agent, or Firm* — Allen, Dyer, Doppelt + Gilchrist. PA

(57) ABSTRACT

A portable case is for power accessories including wires. The portable case includes a housing having first and second sides, first and second ends extending between the first and second sides, and dividing walls extending between one or more of the first and second sides and the first and second ends. The dividing walls define compartments. The housing also includes floor panels respectively within the compartments. The portable case also includes aligned slot pairs carried by the dividing walls, and spindles respectively received by the aligned slot pairs, each spindle configured to receive a wire.

20 Claims, 7 Drawing Sheets

PORTABLE CASE WITH SPINDLES FOR ACCESSORIES AND RELATED METHODS

TECHNICAL FIELD

The present disclosure relates to the field of electrical devices, and, more particularly, to an accessory case for electrical accessories and related methods.

BACKGROUND

Electronic devices are ubiquitous in modern society. Even though most common portable electronic devices are battery powered, these portable electronic devices usually include a charging cable and associated charger power block. Because of this, most households accumulate a large number of different cables and charger power blocks, which are commonly stored in unorganized fashion, making finding the right cable/charger block difficult.

Since most users store their cables and charger power blocks in an unorganized fashion, many users resort to purchasing new cables and charger power blocks even when they are unneeded. This approach leads to user frustration, more e-waste, and increased costs for the user.

SUMMARY

Generally, a portable case is for a plurality of power accessories comprising a plurality of wires. The portable case comprises a housing comprising first and second sides, first and second ends extending between the first and second sides, and a plurality of dividing walls extending between at least one of the first and second sides and the first and second ends. The plurality of dividing walls (i.e., fixed dividing walls) defines a plurality of compartments. The housing also includes a plurality of floor panels respectively within the plurality of compartments. The portable case also includes a plurality of aligned slot pairs carried by the plurality of dividing walls, and a plurality of spindles respectively received by the plurality of aligned slot pairs, each spindle configured to receive a wire from the plurality of wires. Respective slots from each slot pair are carried on opposite sides of a given compartment. Each spindle is respectively received by a respective aligned slot pair.

In some embodiments, the plurality of power accessories may include a charger power block, and at least one floor panel from the plurality of floor panels may comprise a plurality of spaced apart slot pairs. The charger power block may be received by a respective spaced apart slot pair. The plurality of aligned slot pairs may comprise a first set of aligned slot pairs and a second set of aligned slot pairs. Each first aligned slot pair may be spaced apart a first distance, and each second aligned slot pair may be spaced apart a second distance less than the first distance.

Additionally, the plurality of spindles may comprise a first set of spindles and a second set of spindles different from the first set of spindles. Each first spindle may comprise a first spindle body, a handle portion extending upward from the first spindle body, and a plurality of first spindle slots about a periphery of the first spindle body. The plurality of first spindle slots may comprise a first pair of spindle slots, and at least one second pair of spindle slots having a different shape than the first pair of spindle slots. Each second spindle may include a second spindle body, and a plurality of second spindle slots extending inwardly from a side of the second spindle body. Each second spindle slot may comprise a plurality of curved recess pairs.

Also, the portable case may include a cover carried by the first side and configured to cover the plurality of compartments. The portable case further may include a battery testing device carried within a respective compartment.

Another aspect is directed to a method for making a portable case for a plurality of power accessories comprising a plurality of wires. The method includes forming a housing. The housing comprises first and second sides, first and second ends extending between the first and second sides, and a plurality of dividing walls extending between at least one of the first and second sides and the first and second ends. The plurality of dividing walls defines a plurality of compartments. The housing further comprises a plurality of floor panels respectively within the plurality of compartments. The method also includes coupling a plurality of aligned slot pairs to be carried by the plurality of dividing walls, and coupling a plurality of spindles to be respectively received by the plurality of aligned slot pairs, each spindle configured to receive a wire from the plurality of wires.

DETAILED DESCRIPTION

Figure 1:
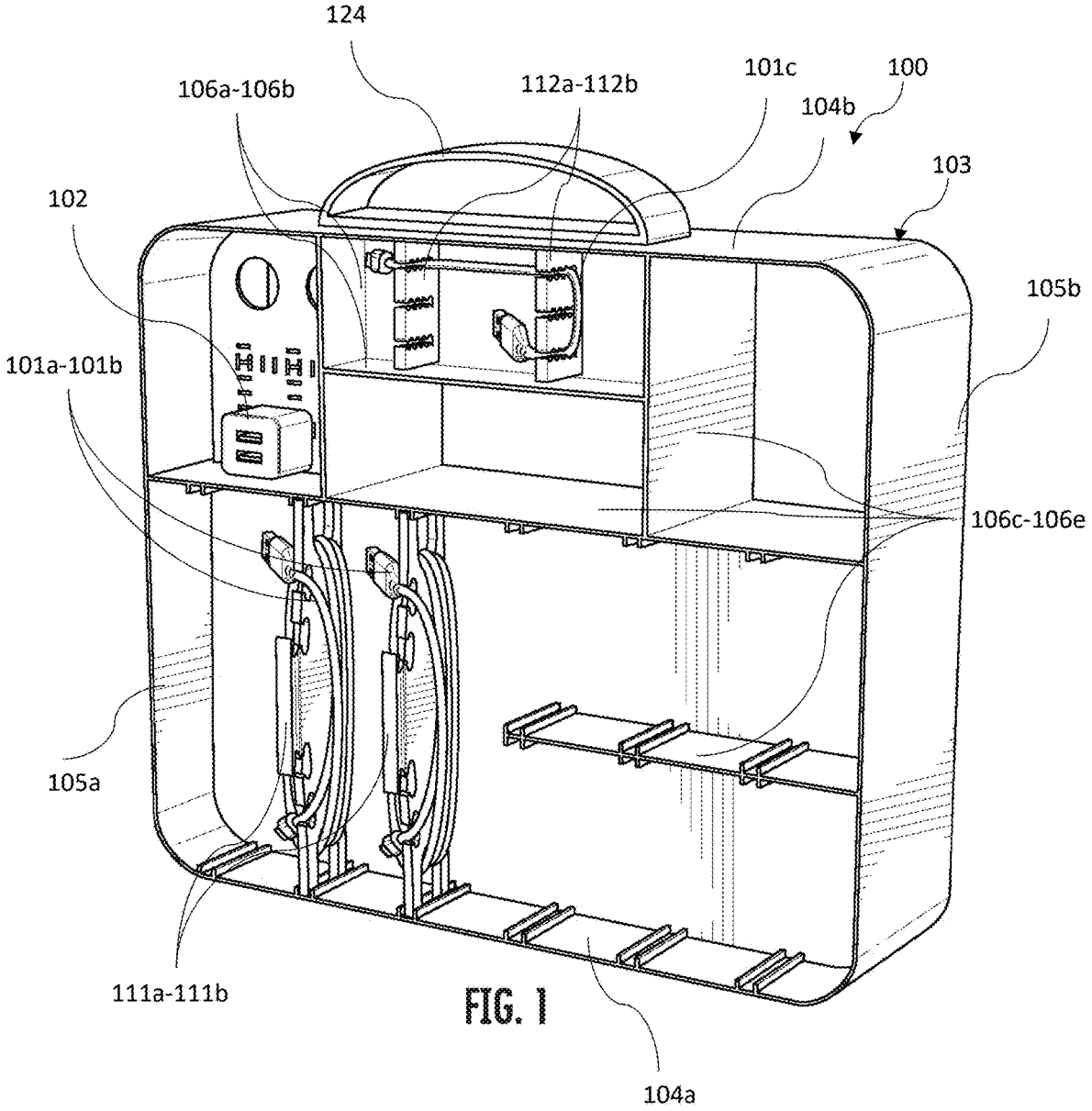
FIG. 1 is a perspective view of a portable case without a cover and with wires and a charging block, according to the present disclosure.
Figure 2:
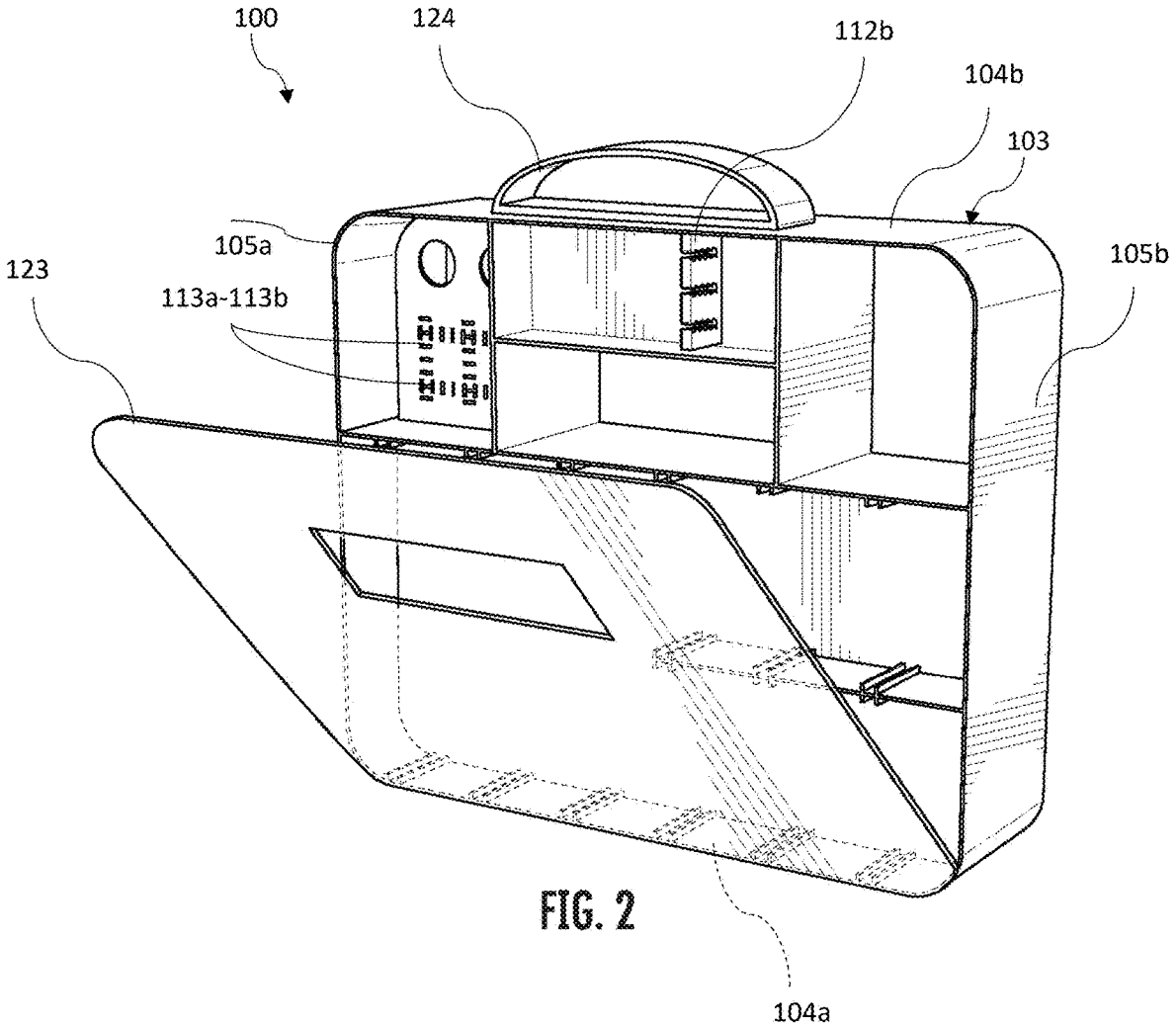
FIG. 2 is a perspective view of the portable case from FIG. 1.
Figure 3:
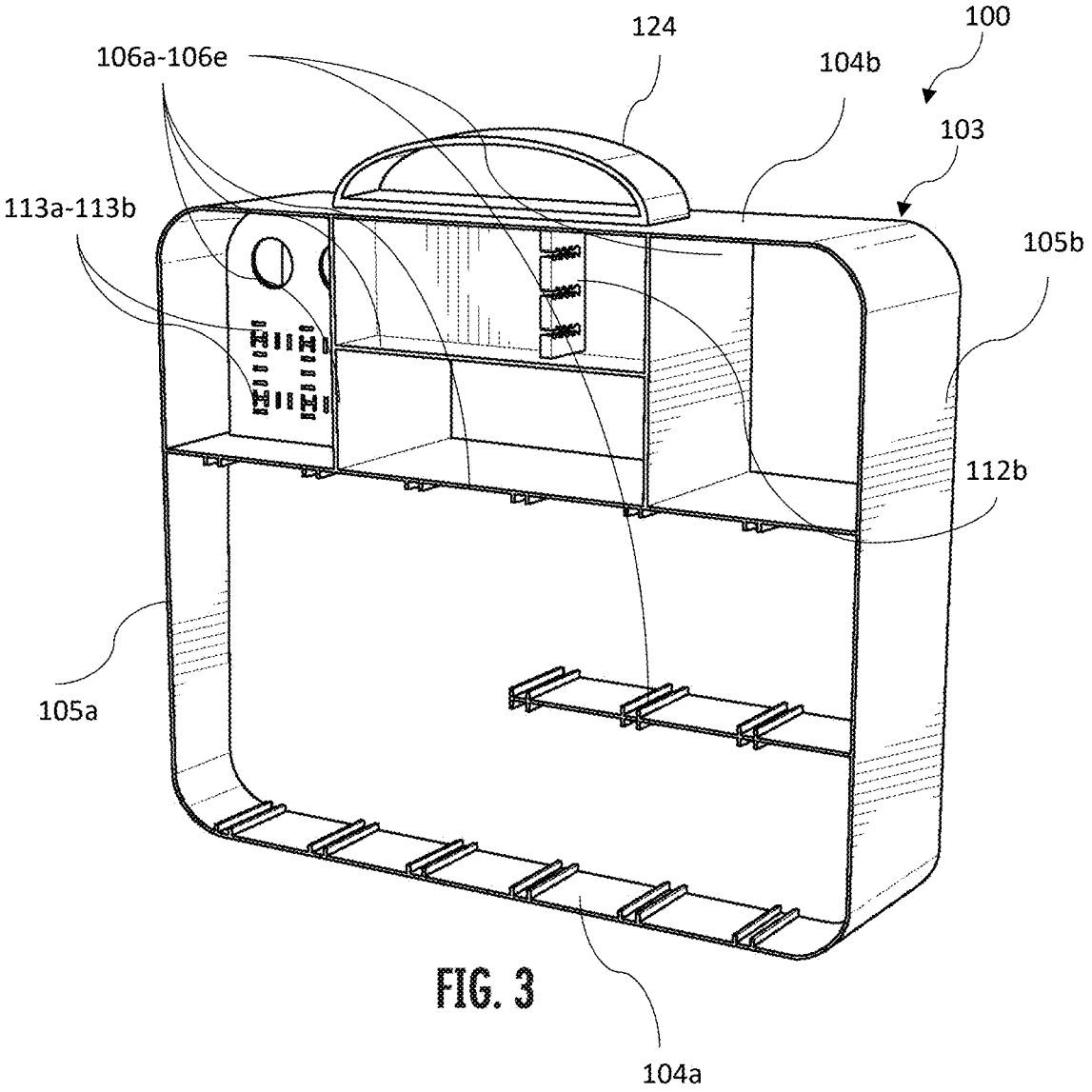
FIG. 3 is another perspective view of the portable case from FIG. 1 without the cover.
Figure 4:
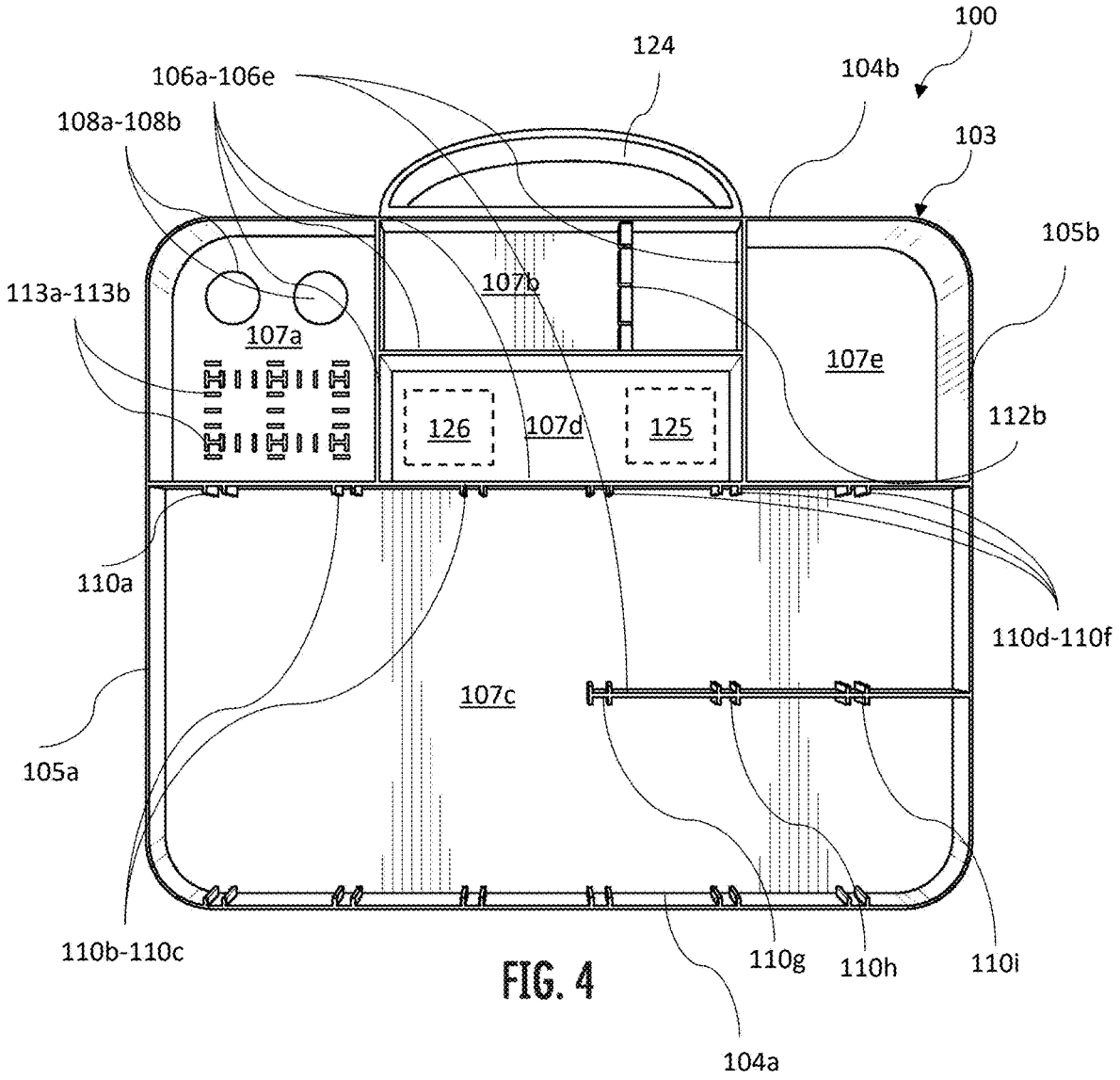
FIG. 4 is a top plan view of the portable case from FIG. 1 without the cover.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout.

Referring initially to FIGS. 1-4, a portable case 100 according to the present disclosure is now described. The portable case 100 is for carrying a plurality of power accessories. The plurality of power accessories illustratively comprises a plurality of wires 101*a*-101*c*, and a charger power block 102 (i.e., an AC/DC adapter block), for example. Of course, other power accessories may be carried by the portable case 100, such as batteries, and cable ties, etc.

The portable case 100 comprises a housing 103 comprising first and second sides 104*a*-104*b*, first and second ends 105*a*-105*b* extending between the first and second sides, and a plurality of dividing walls 106*a*-106*e* extending between the first and second sides, and the first and second ends. The housing 103 may comprise a rigid material of sufficient mechanical strength to resist deformation from typical use;

the rigid material may comprise a plastic polymer material, an acrylic material, a metallic material, or a combination of these materials, for example The plurality of dividing walls 106*a*-106*e* defines a plurality of compartments 107*a*-107*e*. In the illustrated embodiment, the plurality of dividing walls 106*a*-106*e* are substantially planar in shape and linear in length. The housing 103 also includes a plurality of floor panels respectively within some of the plurality of compartments 107*a*-107*c*. The other compartments 107*d*-107*e* have no floor panel. Although not shown, the opposing side of the housing 103 comprises a symmetrical arrangement of separate opposite side compartments. Since the other compartments 107*d*-107*e* include no floor panel, these compartments are contiguous on both sides of the housing 103. The plurality of compartments 107*a*-107*e* illustratively includes rectangles-shaped compartments, but it should be appreciated that other shapes are possible in other embodiments.

The portable case 100 illustratively comprises a plurality of aligned slot pairs 110*a*-110*i* carried by the plurality of dividing walls 106*a*-106*e*, and a plurality of spindles 111*a*-111*b*, 112*a*-112*b* respectively received by the plurality of aligned slot pairs. Each slot from the plurality of aligned slot pairs 110*a*-110*i* illustratively comprises parallel ridges extending from adjacent portions of the housing 103. The plurality of spindles 111*a*-111*b*, 112*a*-112*b* is illustratively configured to receive the plurality of wires 101*a*-101*c*.

In the illustrated embodiment, the floor panel from the first compartment 107*a* comprises a plurality of spaced apart slot pairs 113*a*-113*b*, and a plurality of storage openings 108*a*-108*b*. As perhaps best seen in FIG. 1, connection prongs from the charger power block 102 are illustratively received by a respective spaced apart slot pair 113*a*. For charger power blocks with integrated cables, the cable may be stowed in the opposite side compartment by threading it though one of the plurality of storage openings 108*a*-108*b*. Also, in some embodiments, the plurality of spaced apart slot pairs 113*a*-113*b* may be compatible with one or more of multiple electrical standards, for example, US and European style plugs. Also, the floor panel from the first compartment 107*a* may be removable from the housing 103 and may comprise snap interface tongues (to be received by adjacent portions of the housing) at a periphery thereof. This may allow this compartment to be configurable based upon an application and locale.

The plurality of aligned slot pairs 110*a*-110*i* illustratively comprises a first set of aligned slot pairs 110*a*-110*c* and a second set of aligned slot pairs 110*d*-110*i*. Each first aligned slot pair 110*a*-110*c* is spaced apart a first distance, and each second aligned slot pair 110*d*-110*i* is spaced apart a second distance less than the first distance, thereby receiving different sized spindles. As will be appreciated, the plurality of spindles 111*a*-111*b*, 112*a*-112*b* may comprise different sizes to fit in respective aligned slot pairs 110*a*-110*i* to accommodate varying lengths of wires.

Figure 5:
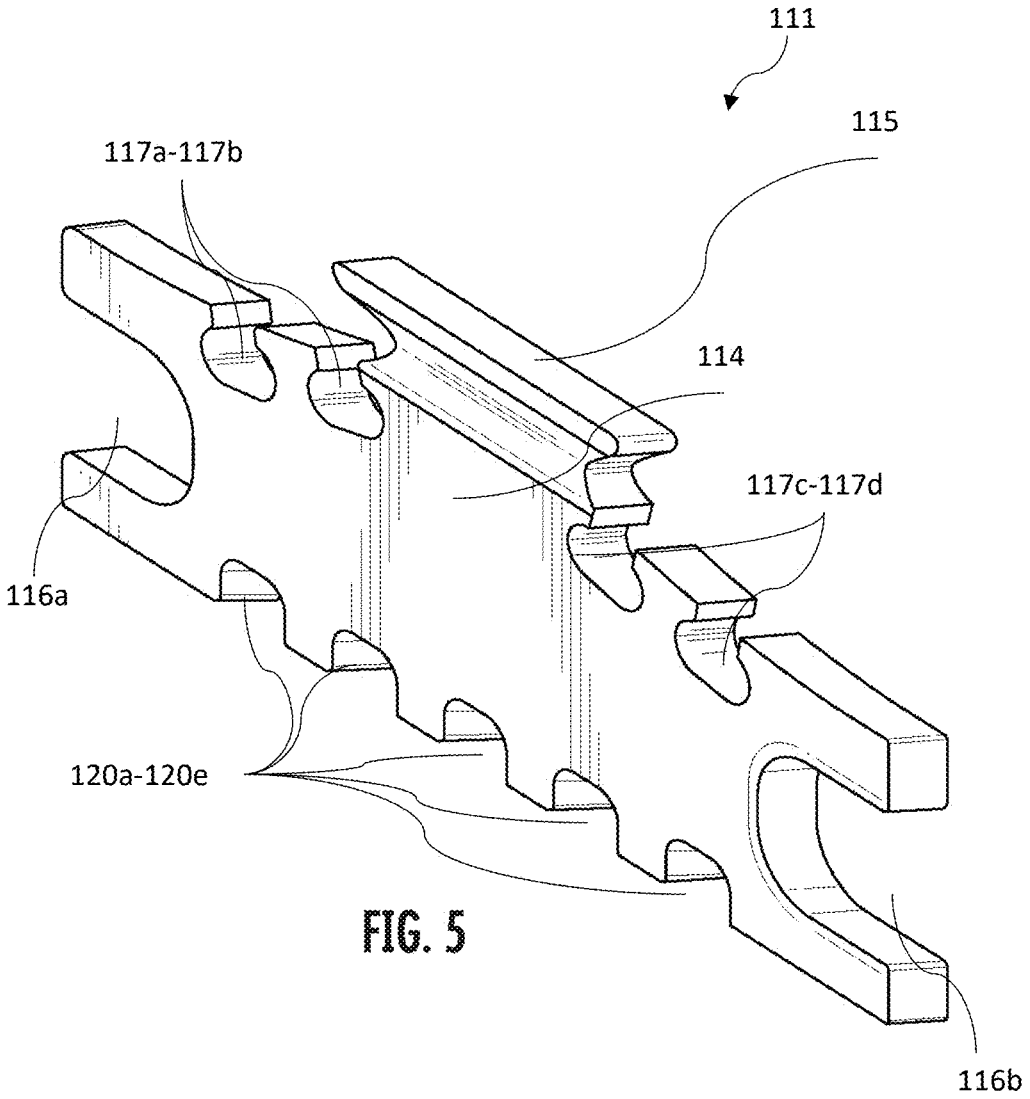
FIG. 5 is a perspective view of a first spindle from the portable case of FIG. 1.
Figure 6:
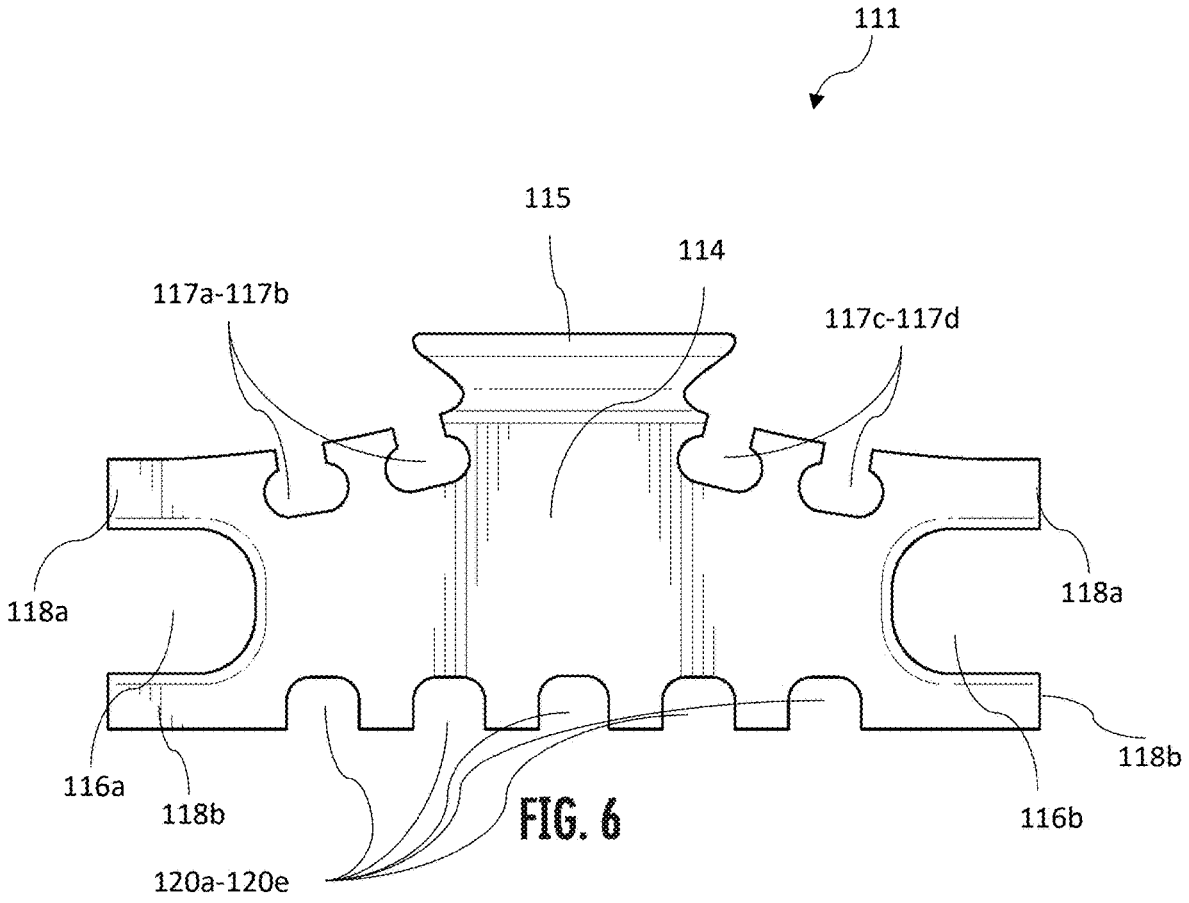
FIG. 6 is a front plan view of the first spindle from the portable case of FIG. 1.
Figure 7:
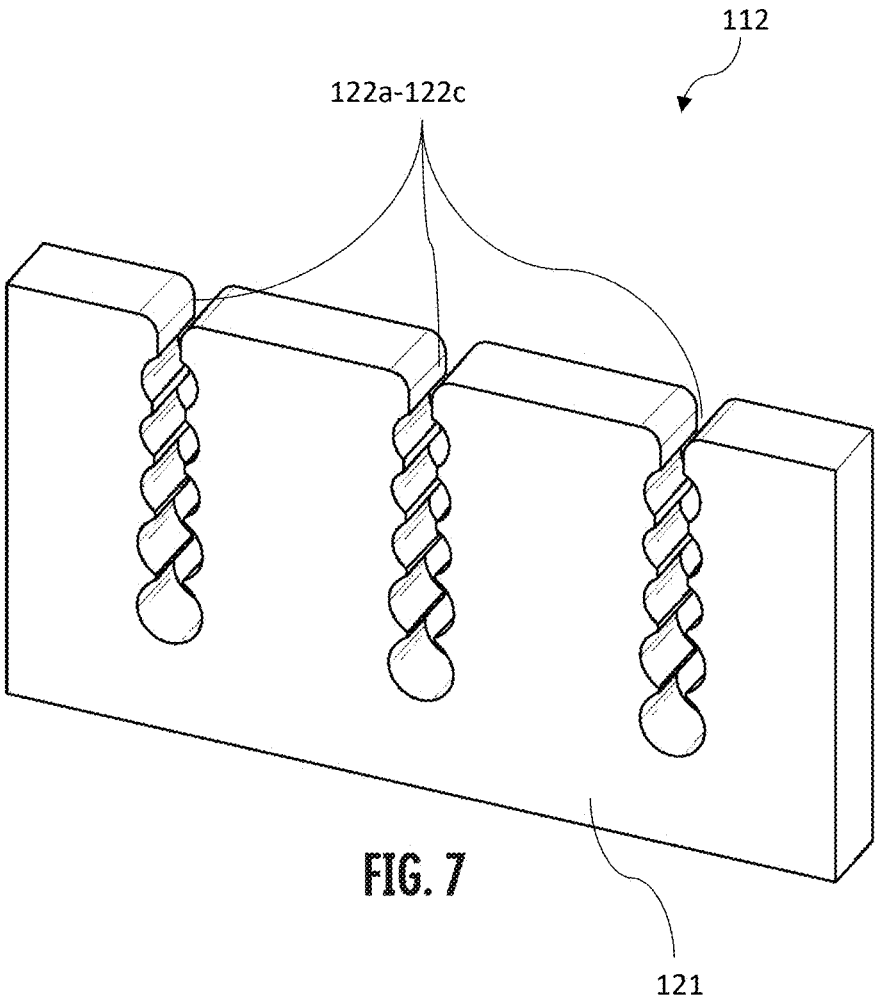
FIG. 7 is a perspective view of a second spindle from the portable case of FIG. 1.

Referring now additionally to FIGS. 5-7, the plurality of spindles 111*a*-111*b*, 112*a*-112*b* illustratively includes a first set of spindles 111*a*-111*b* and a second set of spindles 112*a*-112*b* different from the first set of spindles. Each first spindle 111*a*-111*b* illustratively includes a first spindle body 114 (i.e., an elongate spindle body), a handle portion 115 extending upward from the first spindle body, and a plurality of first spindle slots 116*a*-116*b*, 117*a*-117*d*, 120*a*-120*e* about a periphery of the first spindle body. The plurality of first spindle slots 116*a*-116*b*, 117*a*-117*d*, 120*a*-120*e* illustratively includes a first pair of spindle slots 116*a*-116*b*. In particular, each of the ends of the first spindle body 114 illustratively includes first and second arms 118*a*-118*b* defining the first pair of spindle slots 116*a*-116*b*. The first pair of spindle slots 116*a*-116*b* are illustratively U-shaped and positioned at opposite ends of the first spindle body 114. As will be appreciated, the user may grab the handle portion 115 and insert the first and second arms 118*a*-118*b* of a given first spindle 111*a*-111*b* into a given aligned slot pair 110*a*-110*i*. Further, the handle portion 115 comprises a flat upper surface for receiving adhesive labels for identifying a respective wire. In some embodiments, the first spindle body 114 may comprise a medial opening for receiving fastener. For example, the fastener may comprise a suction cup, permitting the user to remove the spindle and wrapped cable and attach it to a wall in a workplace.

The plurality of first spindle slots 116*a*-116*b*, 117*a*-117*d*, 120*a*-120*e* illustratively includes a plurality of second pairs of spindle slots 117*a*-117*d*, 120*a*-120*e* having a different shape than the first pair of spindle slots 116*a*-116*b*. The plurality of second pairs of spindle slots 117*a*-117*d*, 120*a*-120*e* illustratively includes upper slots 117*a*-117*d* flanking the handle portion 115. Each upper slot 117*a*-117*d* illustratively has a C-shaped inner portion, and a rectangle-shaped outer portion. As shown in FIG. 1, the plug receptacle ends of the plurality of wires 101*a*-101*c* may be tied down via the upper slots 117*a*-117*d*. The plurality of second pairs of spindle slots 117*a*-117*d*, 120*a*-120*e* illustratively includes lower slots 120*a*-120*e* having a U-shape.

Each second spindle 112*a*-112*b* illustratively includes a second spindle body 121, and a plurality of second spindle slots 122*a*-122*c* extending inwardly from a side of the second spindle body. Each second spindle slot 122*a*-122*c* illustratively comprises a plurality of curved recess pairs. As shown in FIG. 1, shorter length wires may be tied down via the second spindle slot 122*a*-122*c*. Via the plurality of curved recess pairs, several shorter length wires can be fitted into the second spindles 112*a*-112*b*. In the illustrated embodiment, the second set of spindles 112*a*-112*b* are press fitted into the second compartment 107*b*. In other embodiments, the portable case 100 may comprise additional aligned slot pairs within the second compartment to hold the second set of spindles 112*a*-112*b*.

Also, the portable case 100 illustratively comprises a cover 123 carried by the first side 104*a* and configured to cover the plurality of compartments 107*a*-107*e*, and a handle 124 carried by the second side 104*b*. Although not shown, the portable case 100 may comprise another cover for closing the separate opposite side compartments. In some embodiments, the portable case 100 may include a battery testing device 125 carried within a respective compartment (noted with dashed box), and/or a cable testing device 126. As will be appreciated, the cable testing device 126 may comprise a plurality of wire connector receptables (e.g., USB type A/C port) for receiving wires under test, a plurality of visual indicators configured to generate a pass indicator and a fail indicator. The cable testing device 126 may comprise an auto-off feature activated based upon the state of the cover 123.

In some embodiments, the portable case 100 has a slimmed down design for reduced weight. In this embodiment, most or all of the plurality of dividing walls 106*a*-106*e* are omitted for a single compartment with boundaries defined by the outer periphery of the housing 103. Here, the plurality of aligned slot pairs 110*a*-110*i* are carried by the outer periphery of the housing 103. This embodiment would represent an easy to carry version, in essence comprising compartment 107*c* with or without the partial medial wall providing spindle size flexibility.

In some embodiments, the portable case 100 comprises a battery power source configured to power the battery testing device 125. Also, the portable case 100 may comprise integrated lighting (e.g., LED light strips) powered by the battery power source. The integrated lighting may be activated based upon the state of the cover 123. For example, when the cover 123 is opened, the integrated lighting may be activated to aid the user while in dark environments.

Another aspect is directed to a method for making a portable case 100 for a plurality of power accessories comprising a plurality of wires 101*a*-101*c*. The method includes forming a housing 103. The housing 103 comprises first and second sides 104*a*-104*b*, first and second ends 105*a*-105*b* extending between the first and second sides, and a plurality of dividing walls 106*a*-106*e* extending between the first and second sides and the first and second ends. The plurality of dividing walls 106*a*-106*e* defines a plurality of compartments 107*a*-107*e*. The housing 103 further comprises a plurality of floor panels respectively within the plurality of compartments 107*a*-107*e*. The method also includes coupling a plurality of aligned slot pairs 110*a*-110*i* to be carried by the plurality of dividing walls 106*a*-106*e*, and coupling a plurality of spindles 111*a*-111*b*, 112*a*-112*b* to be respectively received by the plurality of aligned slot pairs, each spindle configured to receive a wire from the plurality of wires 101*a*-101*c*.

Helpfully, the portable case 100 may easily store a large number of power accessories. Further, with the plurality of aligned slot pairs 110*a*-110*i*, the plurality of spindles 111*a*-111*b*, 112*a*-112*b* may readily configured depending on the storage needs of the user.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. A portable case for a plurality of power accessories comprising a plurality of wires, the portable case comprising:

a housing comprising
- first and second sides,
- first and second ends extending between the first and second sides,
- a plurality of fixed dividing walls extending between at least one of the first and second sides and the first and second ends, the plurality of fixed dividing walls defining a plurality of compartments, and
- a plurality of floor panels respectively within the plurality of compartments;

a plurality of aligned slot pairs carried by the plurality of fixed dividing walls, respective slots from each slot pair being carried on opposite sides of a given compartment;

a plurality of spindles, each spindle respectively received by a respective aligned slot pair, each spindle configured to receive a wire from the plurality of wires; and a cover carried by the first side and configured to cover the plurality of compartments.

2. The portable case of claim 1 wherein the plurality of power accessories comprises a charger power block; and wherein at least one floor panel from the plurality of floor panels comprises a plurality of spaced apart slot pairs, the charger power block to be received by a respective spaced apart slot pair.

3. The portable case of claim 1 wherein the plurality of aligned slot pairs comprises a first set of aligned slot pairs and a second set of aligned slot pairs; wherein each first aligned slot pair is spaced apart a first distance; and wherein each second aligned slot pair is spaced apart a second distance less than the first distance.

4. The portable case of claim 1 wherein the plurality of spindles comprises a first set of spindles and a second set of spindles different from the first set of spindles.

5. The portable case of claim 4 wherein each first spindle comprises a first spindle body, a handle portion extending upward from the first spindle body, and a plurality of first spindle slots about a periphery of the first spindle body.

6. The portable case of claim 5 wherein the plurality of first spindle slots comprises a first pair of spindle slots, and at least one second pair of spindle slots having a different shape than the first pair of spindle slots.

7. The portable case of claim 4 wherein each second spindle comprises a second spindle body, and a plurality of second spindle slots extending inwardly from a side of the second spindle body.

8. The portable case of claim 7 wherein each second spindle slot comprises a plurality of curved recess pairs.

9. The portable case of claim 1 further comprising a battery testing device carried within a respective compartment.

10. The portable case of claim 1 wherein each slot from the plurality of aligned slot pairs comprises ridges extending from adjacent portions of the housing.

11. A method for making a portable case for a plurality of power accessories comprising a plurality of wires, the method comprising:

forming a housing comprising
- first and second sides,
- first and second ends extending between the first and second sides,
- a plurality of fixed dividing walls extending between at least one of the first and second sides and the first and second ends, the plurality of fixed dividing walls defining a plurality of compartments, and
- a plurality of floor panels respectively within the plurality of compartments;

forming a plurality of aligned slot pairs to be carried by the plurality of fixed dividing walls, respective slots from each slot pair being carried on opposite sides of a given compartment;

coupling a plurality of spindles, each spindle to be respectively received by a respective aligned slot pair, each spindle configured to receive a wire from the plurality of wires; and coupling a cover to be carried by the first side and configured to cover the plurality of compartments.

12. The method of claim 11 wherein the plurality of power accessories comprises a charger power block; and wherein at least one floor panel from the plurality of floor panels comprises a plurality of spaced apart slot pairs, the charger power block to be received by a respective spaced apart slot pair.

13. The method of claim 11 wherein the plurality of aligned slot pairs comprises a first set of aligned slot pairs and a second set of aligned slot pairs; wherein each first aligned slot pair is spaced apart a first distance; and wherein each second aligned slot pair is spaced apart a second distance less than the first distance.

14. A portable case for a plurality of power accessories comprising a plurality of wires and a charger power block, the portable case comprising:

a housing comprising first and second sides, first and second ends extending between the first and second sides, a plurality of fixed dividing walls extending between at least one of the first and second sides and the first and second ends, the plurality of fixed dividing walls defining a plurality of compartments, and a plurality of floor panels respectively within the plurality of compartments, at least one floor panel from the plurality of floor panels comprising a plurality of spaced apart slot pairs, the charger power block to be received by a respective spaced apart slot pair;

a plurality of aligned slot pairs carried by the plurality of fixed dividing walls, respective slots from each slot pair being carried on opposite sides of a given compartment, each slot from the plurality of aligned slot pairs comprising ridges extending from adjacent portions of the housing;

a plurality of spindles, each spindle respectively received by a respective aligned slot pair, each spindle configured to receive a wire from the plurality of wires;

a battery testing device carried within a respective compartment; and a cover carried by the first side and configured to cover the plurality of compartments.

15. The portable case of claim 14 wherein the plurality of aligned slot pairs comprises a first set of aligned slot pairs and a second set of aligned slot pairs; wherein each first aligned slot pair is spaced apart a first distance; and wherein each second aligned slot pair is spaced apart a second distance less than the first distance.

16. The portable case of claim 14 wherein the plurality of spindles comprises a first set of spindles and a second set of spindles different from the first set of spindles.

17. The portable case of claim 16 wherein each first spindle comprises a first spindle body, a handle portion extending upward from the first spindle body, and a plurality of first spindle slots about a periphery of the first spindle body.

18. The portable case of claim 17 wherein the plurality of first spindle slots comprises a first pair of spindle slots, and at least one second pair of spindle slots having a different shape than the first pair of spindle slots.

19. The portable case of claim 16 wherein each second spindle comprises a second spindle body, and a plurality of second spindle slots extending inwardly from a side of the second spindle body.

20. The portable case of claim 19 wherein each second spindle slot comprises a plurality of curved recess pairs.

* * * * *